United States Patent [19]

Haga et al.

[11] 4,013,469

[45] Mar. 22, 1977

[54] CHEMICAL DEVELOPMENT OF A SILVER HALIDE EMULSION CONTAINING AN ARYLONIUM SALT ON A POLYESTER FILM SUPPORT

[76] Inventors: Teruhide Haga, 145, 2-Chome, Ogikubo, Suginami, Tokyo; Koichi Horigome, 1407, 2-Chome, Kami-Shakujii, Nerima, Tokyo; Mitsuo Ebisawa, 449, Kamikawa-cho, Hachioji, Tokyo, all of Japan

[22] Filed: Feb. 6, 1976

[21] Appl. No.: 656,083

Related U.S. Application Data

[63] Continuation of Ser. No. 486,582, July 5, 1974, abandoned, which is a continuation of Ser. No. 277,587, Aug. 2, 1972, abandoned, which is a continuation of Ser. No. 60,108, July 31, 1970, abandoned.

[52] U.S. Cl. ..... 96/63; 96/109; 96/110; 96/87 R

[51] Int. Cl.[2] ..... G03C 5/24; G03C 1/34; G03C 1/78

[58] Field of Search ..... 96/63, 109, 95, 110, 96/87 R

[56] References Cited

UNITED STATES PATENTS

| | | | |
|---|---|---|---|
| 2,238,632 | 4/1941 | Dersch et al. | 96/109 |
| 2,288,586 | 6/1942 | Dersch et al. | 96/109 |
| 2,628,167 | 2/1953 | Overman | 96/110 |
| 3,161,506 | 12/1964 | Becker | 96/109 |
| 3,486,901 | 12/1969 | Karlson | 96/109 |
| 3,827,886 | 8/1974 | Ishihra et al. | 96/109 |

*Primary Examiner*—Won H. Louie, Jr.

[57] ABSTRACT

Light-sensitive silver halide photographic materials containing, as an anti-foggant, a compound of the formula

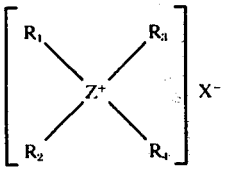

wherein $R_1$, $R_2$, $R_3$ and $R_4$ are individually an aryl or aralkyl group; Z is N, P, As or Sb; and X is an anion. The compositions are particularly suitable for use on polyester supports.

4 Claims, No Drawings

CHEMICAL DEVELOPMENT OF A SILVER HALIDE EMULSION CONTAINING AN ARYLONIUM SALT ON A POLYESTER FILM SUPPORT

CROSS REFERENCE TO RELATED APPLICATIONS

This application is a Continuation application of Ser. No. 486,582, filed July 5, 1974, now abandoned which was a Continuation application of Ser. No. 277,587, filed Aug. 2, 1972, which was a Continuation application of Ser. No. 60,108, filed July 31, 1970, the latter two now abandoned.

The present invention relates to a light-sensitive silver halide photographic material which has been incorporated with a novel anti-foggant in at least one of the layers constituting the photographic material.

Recently, polyester tends to be used frequently, because of its excellent physical properties, as a support for light-sensitive silver halide photographic materials. However, the polyester support contains many impurities such as various by-products, catalyst residue and the like. Some of these impurities increase the fog of the silver halide emulsion coated on the support, and this property tends to be increased greatly in response to the increase in photographic speed of the silver halide emulsion.

On the other hand, quick processing or automatic treatment of light-sensitive photographic materials has been developed, and this means that said treatment is effected, in general, under severe conditions which have never been imagined hitherto. When a light-sensitive silver halide photographic material is treated under severe conditions, the silver halide emulsion tends to be increased in fog. This tendency is greatly promoted in the case where polyester has been used as the support and in the case where a high speed photographic emulsion has been coated on the polyester support.

A principal object of the present invention is to provide a light-sensitive silver halide photographic material having a polyester support which is inhibited from formation of fog due to by-products, catalyst residue and the like impurities contained in the polyester support.

Another object of the invention is to provide a light-sensitive silver halide photographic material which, even when subjected to treatments under severe conditions, e.g. development at an elevated temperature or for a long period of time, is scarcely increased in fog and has excellent photographic properties.

The above-mentioned objects can be accomplished by incorporating a compound of the general formula set forth below into at least one of the layers constituting a light-sensitive silver halide photographic material, e.g. sub layer, inter layer, emulsion layer, protective layer, etc. General formula:

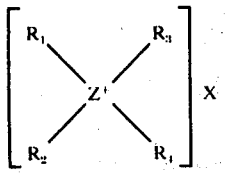

wherein $R_1$, $R_2$, $R_3$ and $R_4$ are individually an aryl or aralkyl group; Z is N, P, As or Sb; and X is an anion.

Typical examples of the compound represented by the above-mentioned general formula are as follows:

(1)

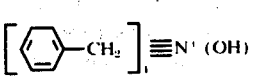

(2)

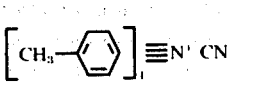

(3)

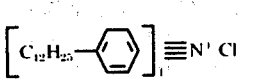

(4)

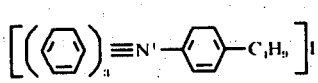

(5)

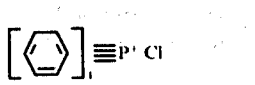

(6)

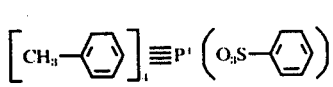

(7)

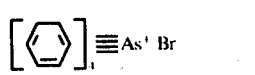

(8)

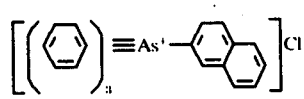

(9)

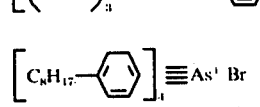

(10)

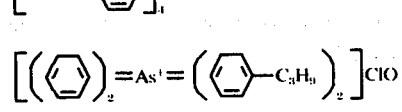

(11)

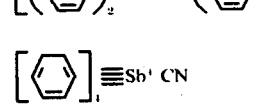

(12)

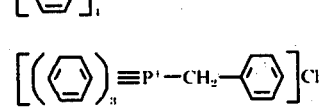

However, compounds usable in the present invention are not limited only to these.

The above-mentioned compounds which are used in the present invention may be added to light sensitive silver halide photographic materials according to an ordinary procedure. In case the compound is desired to be incorporated into the emulsion layer of the photographic material, the amount thereof is within the range of $10^{-2}$ to $10^{-5}$ mole per mole of the silver halide, while in case the compound is desired to be incorporated into any of the sub layer, inter layer, protective layer, etc., the amount thereof is within the range of $10^{-2}$ to $10^{-6}$ per $m^2$ of the photographic material. Even when a polyester has been used as the support, the thus obtained light-sensitive silver halide photographic material is effectively inhibited from increase in fog due to by-products, catalyst residue and the like impurities contained in the polyester support. Further, in the case where another support has been used, the photographic material is successfully inhibited from increase in fog due to treatments under severe conditions, e.g. development at an elevated temperature or for a long period of time, or due to storage at normal or elevated temperature.

As the silver halide in the present invention, there may be effectively used any of silver bromide, silver iodobromide, silver chloride, silver chlorobromide, etc. The above-mentioned compounds employed in the present invention have no detrimental interactions on, and hence can be effectively used in combination with, such additives for light-sensitive silver halide photographic materials as various inhibitors, stabilizers, sensitizing dyes, couplers, sensitizers, hardeners, etc.

The compounds employed in the present invention are further enhanced in their excellent anti-fogging effects when used in combination with compounds of elements belonging to the "aluminum series", by which is meant metallic elements of Group IIIb of the Periodic table. Typical examples of the compounds of elements belonging to the aluminum series are as follows:

a. $AlBr_3$
b. $Al_2O_3$
c. $Al_2(SO_4)_3$
d. $Ga_2S$
e. $GaBr_2$
f. $Ga(NO_3)_3$
g. $In_2S$
h. InSe
i. $In_2(SO_4)_3$
j. TlOH
k. $TlNO_3$
l. $Tl(NO_3)_3$

These compounds are represented by the general formulas set forth below.

$$M^{+}A \quad (I)$$

$$(M^{+})_2B \quad (II)$$

wherein $M^{+}$ is $Ga^{+}$, $In^{+}$ or $Tl^{+}$,
$A^{-}$ is $OH^{-}$, $NO_3^{-}$ or halogen, and
$B^{--}$ is $O^{--}$, $S^{--}$, $Se^{--}$ or $SO_4^{--}$, $$M^{++}(C^{-})_2 \quad (III)$$

$$M^{++}D \quad (IV)$$

wherein $M^{++}$ is $Ga^{++}$ or $In^{++}$,
$C^{-}$ is $NO_3^{-}$ or halogen, and
$D^{--}$ is $O^{--}$, $S^{--}$, $Se^{--}$ or $SO_4^{--}$.

$$M^{+++}(E^{-})_3 \quad (V)$$

$$(M^{+++})_2(F^{--})_3 \quad (VI)$$

wherein $M^{+++}$ is $Al^{+++}$, $Ga^{+++}$, $In^{+++}$ or $Tl^{+++}$,
$E^{-}$ is $NO_3^{-}$ or halogen, and
$F^{--}$ is $O^{--}$, $Se^{--}$ or $SO_4^{--}$.

The above-mentioned compounds of elements belonging to the aluminum series which are represented by the general formulas (I) to (VI) may be added to light-sensitive silver halide photographic materials according to an ordinary procedure. In case the said compound is desired to be incorporated into the emulsion layer of the photographic material, the amount thereof is within the range of $10^{-2}$ to $10^{-6}$ mole per mole of the silver halide, while in case the compound is to be incorporated into any of the sub layer, inter layer, protective layer, etc., the amount thereof is within the range of $10^{-2}$ to $10^{-7}$ mole per $m^2$ of the photographic material. The compound may be incorporated into a layer containing the anti-foggant represented by the aforesaid general formula or into a layer adjacent thereto. The thus obtained light-sensitive silver halide photographic material is more enhanced in anti-fogging effect than in the case where the anti-foggant represented by the aforesaid general formula has been used alone.

The present invention is illustrated in further detail below with reference to examples, but it is needless to say that the invention is not limited to the examples.

EXAMPLE 1

A gelatin emulsion of 60 g. of silver iodobromide containing 1.5 mole% of silver iodide was subjected at the time of second ripening to gold sensitization. After completion of the second ripening, the emulsion was added with an aqueous solution of 1,2-benzo-5-methyl-7-hydroxy-3,4,7a-triazaindene and an alcohol solution of 1-phenyl-5-mercaptotetrazole, and with formalin and saponin. Subsequently, the emulsion was coated on each of a cellulose triacetate support and a polyester support, followed by drying, to prepare samples (1) and (2).

On the other hand, the above-mentioned emulsion was incorporated with the compound 10 in a proportion of 100 mg. per 60 g. of the silver halide and then coated on a polyester support, followed by drying, to prepare a sample 3 of the present invention.

Each of the thus prepared samples 1 to 3 was developed, immediately after preparation, with developers 1 and 2 of the compositions set forth below. Further, each sample was allowed to stand for 5 days at a temperature of 55° C. and a humidity of 5%, and then developed with the developer (2).

| | |
|---|---|
| Developer (1): | |
| Sodium sulfite | 70 g. |
| Hydroquinone | 10 g. |
| Boric acid anhydride | 1 g. |
| Sodium carbonate (monohydrate) | 20 g. |
| 1-Phenyl-1,3-pyrazolidone | 0.35 g. |
| Sodium hydroxide | 5 g. |
| 5-Methylbenzotriazole | 0.05 g. |
| Potassium bromide | 5 g. |
| Phthalaldehyde bisulfite | 15 g. |
| Acetic acid | 8 g. |
| Water to make | 1 liter. |
| Developer (2): | |
| Metol | 3.5 g. |
| Sodium sulfite | 60 g. |
| Hydroquinone | 9 g. |
| Sodium carbonate (monohydrate) | 53 g. |
| Potassium bromide | 4 g. |
| Water to make | 1 liter. |

Thereafter, the developed samples were subjected to sensitometry to obtain the results shown in Table 1.

Table 1

| Sample | Immediately after preparation: Developed with developer (1) at 40° C. for 30 sec. Fog | Speed | Developed with developer (2) at 20° C. for 7 min. 30 sec. Fog | Speed | After heat treatment (55° C., 5% RH, 5 days): Developed with developer (2) at 20° C. for 4 min. 30 sec. Fog | Speed |
|---|---|---|---|---|---|---|
| Sample (1) | 0.12 | 100 | 0.20 | 100 | 0.23 | 100 |
| Sample (2) | 0.38 | 110 | 0.32 | 120 | 0.41 | 95 |
| Sample (3) | 0.13 | 105 | 0.18 | 110 | 0.24 | 100 |

In the table, the speed was represented by a relative speed, assuming as 100 the speed of the sample 1.

As is clear from the above table, the sample 3 according to the present invention is completely inhibited, without being injured in photographic properties, from increase in fog due to the polyester support, even when subjected to the development at a high temperature or for a long time or to the development after heat treatment.

EXAMPLE 2

A gelatin emulsion of 60 g. of silver iodobromide containing 1.5 mole% of silver iodide was subjected at the time of second ripening to gold sensitization. After completion of the second ripening, the emulsion was subjected to optical sensitization, charged with an aqueous solution of 1,2-benzo-5-methyl-7-hydroxy-3,4,7a-triazaindene, and with formalin and saponin, and then equally divided into two portions. One portion of the emulsion was incorporated with the compound 2 in a proportion of 300 mg. per 60 g. of the silver halide. The two emulsions were individually coated on a cellulose triacetate support, followed by drying, to prepare samples. Thereafter, the samples were developed and then subjected to sensitometry to obtain the results shown in Table 2.

Table 2

| Sample | Immediately after preparation: Developed with developer (1) at 36° C. for 45 sec. Fog | Speed | Developed with developer (1) at 36° C. for 90 sec. Fog | Speed | After allowing to stand for 6 months: Developed with developer (1) at 36° C. for 45 sec. Fog | Speed |
|---|---|---|---|---|---|---|
| Blank sample | 0.16 | 100 | 0.30 | 100 | 0.25 | 100 |
| Sample of the invention | 0.14 | 98 | 0.22 | 100 | 0.20 | 100 |

In the table, the speed was represented by a relative speed, assuming as 100 the speed of the blank sample, and the developer 1 was the same as in Example 1.

From the above table, it is understood that also in the case where the cellulose triacetate support is used, the sample incorporated with the compound 2 can be effectively inhibited, without being deteriorated in speed, from increase in fog even when subjected to the development at high temperature immediately after preparation and after being allowed to stand.

EXAMPLE 3

A subbing liquid was divided into two portions, and one portion was incorporated with the compound 6 in an amount of 0.3 g. per $m^2$, while the other portion was left untreated. These two solutions were individually coated on a polyester support and then dried.

On the other hand, a gelatin emulsion of 60 g. of silver iodobromide containing 1.5 mole% of silver iodide was subjected at the time of second ripening to gold sensitization. After completion of the second ripening, the emulsion was charged with an aqueous solution of 1,2-benzo-5-methyl-7-hydroxy-3,4,7a-triazaindene and an alcohol solution of 1-phenyl-5-mercaptotetrazole, and with formalin and saponin.

The thus treated emulsion was coated on each of the aforesaid supports, followed by drying, to prepare samples. After development, the samples were subjected to sensitometry to obtain the results as shown in Table 3.

Table 3

| Sample | Developed with developer (1) at 40° C. for 90 sec.: Immediately after preparation Fog | Speed | After heat treatment at high humidity (55° C., 80% RH, 6 days) Fog | Speed |
|---|---|---|---|---|
| Blank sample | 0.63 | 100 | 0.40 | 100 |
| Sample of the invention | 0.24 | 95 | 0.26 | 110 |

In the table, the speed was represented by a relative speed, assuming as 100 the speed of the blank sample, and the developer 1 was the same as in Example 1.

From the above table, it is clear that also in the case where the compound 6 is added to the sub layer, excellent anti-fogging effects are displayed, and the said effects are maintained even after treatment at such high temperature and humidity as 55° C. and 80% humidity.

EXAMPLE 4

A gelatin emulsion of 60 g. of silver iodobromide containing 1.5 mole% of silver iodide was subjected at the time of second ripening to gold sensitization. After completion of the second ripening, the emulsion was charged with an aqueous solution of 1,2-benzo-5-methyl-7-hydroxy-3,4,7a-triazaindene and an alcohol solution of 1-phenyl-5-mercaptotetrazole.

Subsequently, the emulsion was equally divided, charged with such additives as shown in Table 4, and coated on each of a polyester support and a cellulose triacetate support, followed by drying, to prepare samples. After development, the samples were subjected to sensitometry to obtain the results set forth in Table 4.

Table 4

| Support | Additive (mg/Ag × 60 g) | Immediately after preparation: Developed with developer (1) at 40° C. for 90 sec. Fog | Speed | Developed with developer (2) at 20° C. for 10 min. Fog | Speed | After allowing to stand for 6 months. Developed with developer (1) at 40° C. for 30 sec. Fog | Speed |
|---|---|---|---|---|---|---|---|
| Cellulose Triacetate | — | 0.25 | 100 | 0.30 | 100 | 0.28 | 100 |
| Polyester | — | 0.70 | 95 | 0.40 | 120 | 0.83 | 85 |
| Polyester | Exemplified compound (5) 50 mg. | 0.30 | 110 | 0.33 | 100 | 0.35 | 100 |
| Polyester | Exemplified compound (5) 50 mg. + $TlNO_3$ 5 mg. | 0.23 | 105 | 0.26 | 95 | 0.25 | 100 |

In the table, the speed was represented by a relative speed, assuming as 100 the speed of the sample using the cellulose triacetate support, and the developers 1 and 2 were the same as in Example 1.

From the above table, it is understood that by incorporation of the exemplified compound 5, fog is successfully inhibited, and the said effect can be further enhanced by using said compound in combination with thallium nitrate.

EXAMPLE 5

A gelatin emulsion of 60 g. of silver iodobromide containing 1.5 mole% of silver iodide was subjected at the time of second ripening to gold sensitization. After completion of the second ripening, the emulsion was charged with an aqueous solution of 1,2-benzo-5-methyl-7-hydroxy-3,4,7a-triazaindene. Formalin and saponin were also added. Subsequently, the emulsion was equally divided, charged with such additives as shown in Table 5, and coated on each of a polyester support and a cellulose acetate support, followed by drying, to prepare samples. After development, the samples were subjected to sensitometry to obtain the results set forth in Table 5.

Table 5

| Support | Additive (mg/Ag × 60 g) | Immediately after Preparation Developed with developer (1) at 40° C. for 90 sec. Fog | Speed | After allowing to stand for 6 months Developed with developer (1) at 40° C. for 30 sec. Fog | Speed |
|---|---|---|---|---|---|
| Cellulose Triacetate | — | 0.40 | 100 | 0.35 | 100 |
| Polyester | — | 0.85 | 90 | 0.76 | 85 |
| Polyester | Compound (12) 60 mg. | 0.17 | 100 | 0.15 | 100 |

In the table, the speed was represented by a relative speed, assuming as 100 the speed of the sample using the cellulose triacetate support, and the developer 1 was the same as in Example 1.

From the above table, it is understood that by incorporation of the compound 12, fog is successfully inhibited, without use of 1-phenyl-5-mercaptotetrazole, and further any decrease in speed does not take place.

What is claimed is:

1. A process for forming a silver image in a light-sensitive silver halide photographic material comprising a polyester film support, one or more layers on said support, including a silver halide emulsion layer and, incorporated in at least one of said layers, an antifogging amount of a compound having the formula

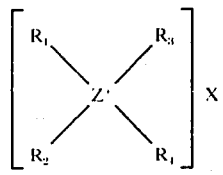

wherein $R_1$, $R_2$, $R_3$, and $R_4$ are individually benzyl, phenyl, naphthyl or $C_1$ to $C_{12}$ - alkyl phenyl group; Z is N, P, As or Sb; and X is an anion, said process comprising the steps of imagewise exposing said light-sensitive silver halide photographic material to light and developing the exposed material essentially only by treating with an aqueous silver halide developer.

2. A process as claimed in claim 1 wherein the photographic material also comprises an inorganic compound which is the source of a cation of an element selected from the group consisting of aluminum, gallium, indium and thallium.

3. A process as claimed in claim 2 wherein said inorganic compound is one member defined by one of the following formulas (I) to (VI):

$$M^{+}A \quad (I)$$

$$(M^{+})_2B \quad (II)$$

wherein $M^+$ is $Ga^+$, $In^+$, or $Tl^+$, $A^-$ is $OH^-$, $NO_3^-$ or halogen, and $B^{--}$ is $O^{--}$, $S^{--}$, $Se^{--}$ or $SO_4^{--}$, $$M^{++}(C^{-})_2 \quad (III)$$

$$M^{++}D \quad (IV)$$

wherein $M^{++}$ is $Ga^{++}$ or $In^{++}$, $C^{-}$ is $NO_3^{-}$ or halogen, and $D^{--}$ is $O^{--}$, $S^{--}$, $Se^{--}$ or $SO_4^{--}$, $$M^{+++}(E^{-})_3 \qquad (V)$$

$$(M^{+++})_2(F^{--})_3 \qquad (VI)$$

wherein $M^{+++}$ is $Al^{+++}$, $Ga^{+++}$, $In^{+++}$ or $Tl^{+++}$, $E^{-}$ is $NO_3^{-}$ or halogen, and $F^{--}$ is $O^{--}$, $S^{--}$, $Se^{--}$ or $SO_4^{--}$.

4. A process for forming a silver image in a light-sensitive silver halide photographic material comprising a polyester film support, one or more layers on said support, including a silver halide emulsion layer and, incorporated in at least one of said layers, an antifogging amount of a compound having the general formula

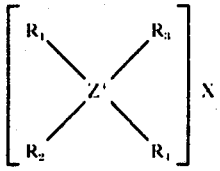

wherein $R_1$, $R_2$, and $R_4$ are individually benzyl, phenyl, naphthyl or $C_1$ to $C_{12}$-alkylphenyl group; Z is N, P, As or Sb; and X is an anion, in combination with $TlNO_3$, said process comprising the steps of imagewise exposing said light-sensitive silver halide photographic material to light and developing the exposed material essentially only by treating with an aqueous silver halide developer.

* * * * *